US009284813B2

(12) United States Patent
Porta

(10) Patent No.: US 9,284,813 B2
(45) Date of Patent: Mar. 15, 2016

(54) SWELLABLE ENERGIZERS FOR OIL AND GAS WELLS

(71) Applicant: FREUDENBERG OIL & GAS, LLC, Plymouth, MI (US)

(72) Inventor: Santiago Galvez Porta, Peterhead (GB)

(73) Assignee: FREUDENBERG OIL & GAS, LLC, Plymouth, MI (US)

( * ) Notice: Subject to any disclaimer, the term of this patent is extended or adjusted under 35 U.S.C. 154(b) by 178 days.

(21) Appl. No.: 13/914,037

(22) Filed: Jun. 10, 2013

(65) Prior Publication Data

US 2014/0361497 A1 Dec. 11, 2014

(51) Int. Cl.

| | |
|---|---|
| ***E21B 33/12*** | (2006.01) |
| ***E21B 33/04*** | (2006.01) |
| *E21B 33/00* | (2006.01) |

(52) U.S. Cl.

CPC ..... *E21B 33/1208* (2013.01); *E21B 33/04* (2013.01); *E21B 2033/005* (2013.01)

(58) Field of Classification Search

CPC ..... E21B 33/12; E21B 33/122; E21B 33/127; E21B 33/128

See application file for complete search history.

(56) References Cited

U.S. PATENT DOCUMENTS

| | | | | |
|---|---|---|---|---|
| 2,849,070 | A * | 8/1958 | Maly | 277/336 |
| 4,039,489 | A | 8/1977 | Fletcher et al. | |
| 4,234,197 | A | 11/1980 | Amancharla | |
| 4,811,959 | A | 3/1989 | Bullard et al. | |
| 5,037,281 | A * | 8/1991 | Lane et al. | 418/55.4 |
| 7,228,915 | B2 * | 6/2007 | Thomson | 166/387 |
| 8,127,978 | B2 | 3/2012 | Castillo et al. | |
| 8,240,673 | B2 | 8/2012 | Manninen | |
| 2007/0246225 | A1 | 10/2007 | Hailey, Jr. et al. | |
| 2008/0210418 | A1 | 9/2008 | Knippa et al. | |
| 2009/0205841 | A1 | 8/2009 | Kluge et al. | |
| 2011/0088891 | A1 | 4/2011 | Stout | |
| 2012/0031608 | A1 | 2/2012 | Lembeke et al. | |

FOREIGN PATENT DOCUMENTS

| | | |
|---|---|---|
| EP | 0 208 048 | 11/1990 |
| EP | 1805391 | 12/2008 |

OTHER PUBLICATIONS

International Search Report from corresponding PCT Appln. No. PCT/US14/31791 dated Nov. 7, 2014.

"PTFE Seal Design Guide", Parker Hannifin Corp., p. 17, Belgium, 2011.

"Tubing Seal Assembly Components", Concept 2 Completion PTE LTD, Singapore. Downloaded from www.C2C.com.sg on Jun. 9, 2013.

* cited by examiner

*Primary Examiner* — Gilbert Lee

(74) *Attorney, Agent, or Firm* — Grossman, Tucker, Perreault & Pfelger, PLLC

(57) ABSTRACT

A seal stack including a sealing element including an annular seal ring having a diameter and an axis defined therethrough perpendicular to the diameter, a groove defined in the seal ring, wherein the groove has an opening at a first end of the seal ring, and a swellable energizer disposed in the groove, wherein the swellable energizer swells upon exposure to a solvent causing the seal ring to expand. The seal stack also includes a first annular back-up and a second annular back-up provided at opposing ends of the sealing element, wherein said first back-up includes an interior surface that receives a second end of the sealing element.

20 Claims, 9 Drawing Sheets

SWELLABLE ENERGIZERS FOR OIL AND GAS WELLS

FIELD OF INVENTION

The present disclosure relates to swellable energizers for oil and gas wells. In particular, the present disclosure relates to the use of a fluid swellable material that is used to energize a seal in oil and gas wells.

BACKGROUND

In the oil and gas industry, one or more casings or pipes are placed into the well bore. In addition to production pipe, which is used to extract hydrocarbons from the well, a well liner and various casings are optionally present. For example, a conductor casing, may be installed to prevent the top of the well from caving in and aid in the process of circulating the drilling fluid up from the bottom of the well. A surface casing may also be present. The surface casing fits into the top of the conductor casing and extends a few hundred feet to a few thousand feet into the well. The surface casing protects fresh water deposits near the surface of the well from being contaminated by leaking hydrocarbons or salt water from deeper in the ground. Intermediate casings or liner strings are placed to mitigate hazards caused by abnormal underground pressure zones, underground shale, and formations that might otherwise contaminate the well, such as salt water deposits.

In addition, a wellhead is used to prevent oil and natural gas leaking out of the well and to prevent blowouts. It is mounted at the well opening and is used to manage the extraction of hydrocarbons from the well. The well head generally includes a casing head, tubing head and a christmas tree. The casing head includes heavy fittings and supports the length of the casing that is run into the well and includes seals between the fittings and the casing. The tubing head provides a seal between the production pipe and the surface. The tubing head also supports the length of production pipe and provide connections at the surface which allow the flow of the fluids out of the well to be controlled. The christmas tree fits on top of the casing head and tubing head and contains tubes and valve that control the flow of hydrocarbons and other fluids out of the well.

Various seals may be positioned within the well between the casings and production pipe, between the casings and casing head, and the production pipe and tubing head. Standard seals (e.g., non-swellable o-rings) or swellable seals (e.g., swellable o-rings, swelling packing elements, etc) generally do not perform well in damaged bores and/or in gas applications.

SUMMARY

An aspect of the present disclosure relates to a seal stack. The seal stack includes an annular sealing element, a first annular back-up and a second annular back-up. The annular seal element includes an annular seal ring having a diameter and an axis defined therethrough perpendicular to the diameter. The annular seal ring also includes a groove defined in the ring, wherein the groove has an opening at a first end of the seal ring. A swellable energizer is disposed in the groove, wherein the swellable energizer expands upon exposure to a solvent causing the annual seal ring to expand. The first annular back-up and the second annular back-up are provided at opposing ends of the sealing element. The first back-up includes an interior surface that receives a second end of the sealing ring.

Another aspect of the present disclosure relates to a cup seal sub-assembly. The cup seal sub-assembly includes a carriage having an interior surface and an exterior surface. The carriage also includes a leg portion forming a portion of the interior surface of the carriage and a body portion. In addition, a finger extends from the body portion of the carriage. A cup seal is positioned between the leg portion of the carriage and the finger. The cup seal includes a sealing projection and at least a portion of an external surface of the sealing projection contacts an internal surface of the finger. The cup seal sub-assembly also includes a swellable energizer positioned between the leg portion of the carriage and the cup seal, wherein upon swelling the swellable actuator extends the sealing projection and finger outward from the carriage.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

The present disclosure relates to seals including swellable energizers for oil and gas wells. In particular, the present disclosure relates to the use of a fluid swellable material that is used to actuate seals or pistons in oil and gas wells. Therefore, a swellable energizer may be understood as a body, which upon swelling and volumetric expansion, actuates or expands a seal. The swellable materials used to energize the seals and pistons include a swellable elastomeric material, such as nitrile-butadiene rubber (NBR), hydrogenated NBR (HNBR), chemically functionalized NBR (XNBR), ethylene-propylene-diene-copolymer (EPDM), ethylene-propylene rubber (EPR), fluorinated elastomers (FKM, FFKM. FEPM), styrene-isoprene rubber (SBR), hydrogenated styrene-isoprene rubber (HSBR), isoprene-butadiene rubber (IBR), hydrogenated isoprene-butadiene rubber (HIBR), styrene-isoprene rubber (SIR), hydrogenated styrene-isoprene rubber (HSIR), styrene-butadiene-isoprene rubber (SIBR), hydrogenated styrene-butadiene-isoprene rubber (HSIBR), block, triblock and multi-block polymers of styrene-isoprene, styrene-butadiene, styrene-butadiene-isoprene thermoplastic elastomers, hydrogenated block, triblock and multi-block polymers of styrene-isoprene, styrene-butadiene, styrene-butadiene-isoprene thermoplastic elastomers, silicone rubbers, chlorosulfonated polyethylene (CSM), or mixtures and combinations thereof. The swellable elastomeric material swells upon exposure to a solvent. Solvents herein include hydrocarbons, process water or combinations thereof. Hydrocarbons may include oil or natural gas, or non-aqueous muds (oil drilling muds). Process water may include brine, salt water, water-based mud, or water containing minerals, or other water which is naturally located under the ground surface or fed into the well hole.

Figure 1A:
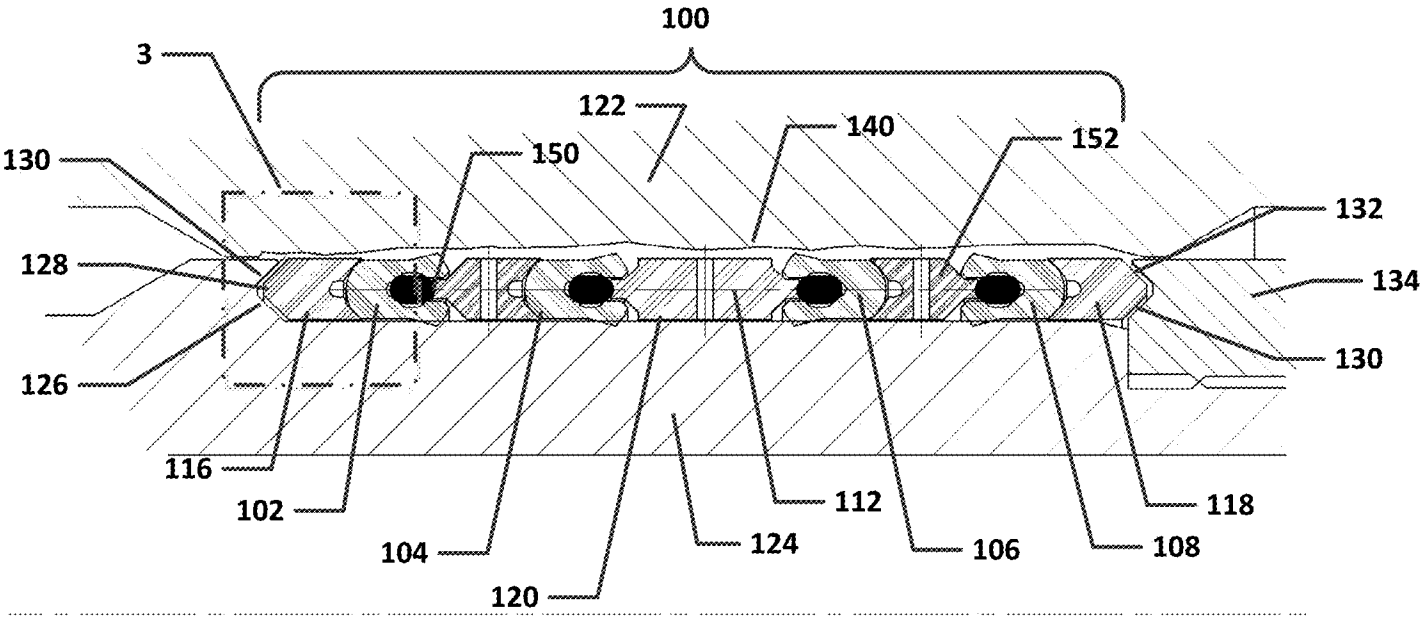
FIG. 1*a* illustrates an embodiment of a seal stack, taken through a cross-section of the seal stack, including four sealing elements or four sealing rings including swellable energizers, a center spacer and back-ups positioned on either end of the stack.

In one embodiment, illustrated in FIG. 1*a*, a v-seal ring stack is provided. The V-seal ring stack 100 includes a number of annular seal elements 102, 104, 106, 108 including sealing rings, a center spacing member 112, and back-up members 116, 118. While four seal elements are illustrated, wherein two elements are positioned on either side of the center spacing member, any arrangement of seal elements may be present. For example, 1 to 10 seal elements may be provided on both sides of the spacer. In addition, the same number or a different number of elements may be present on either side of the spacer. In other embodiments, seal element(s) are positioned on one side of the center spacer or a center spacer is not present.

Figure 1B:
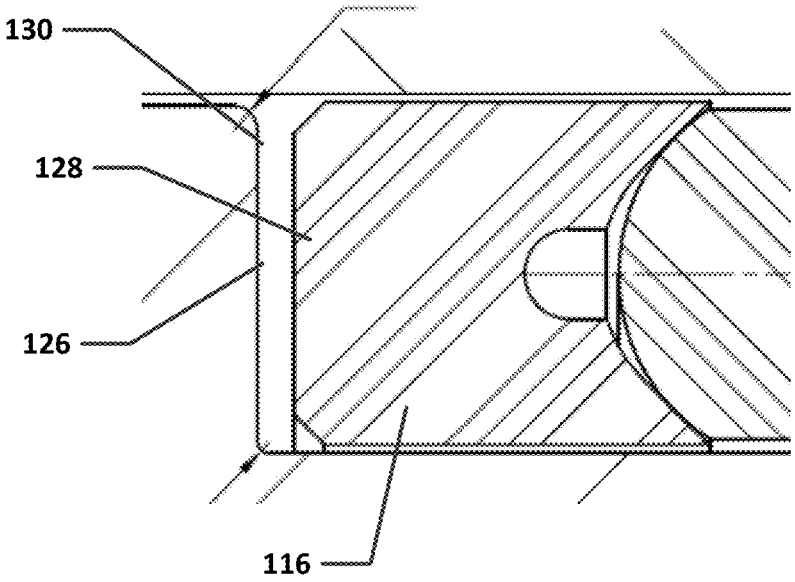
FIG. 1*b* illustrates an embodiment of a back-up arranged in a seal stack, taken through a cross-section of the seal stack.

The seal stack 100 is positioned within a seal gland 120. As illustrated, the seal gland 120 may be defined between an outer cylinder 122 and an inner cylinder 124. The outer cylinder may include a damaged safety valve bore, packer sealing bore, casing bore, tubing bore, liner bore or other outer cylinder. The inner cylinder may include an inner safety valve, straddle, stinger, or other inner cylinder. The seal gland 120 may also be located in a stuffing box or otherwise located between production pipe and casings, or between casings. The inner cylinder 124 may include a shoulder 126 upon which the seal ring stack 100 may rest. As illustrated, the shoulder 126 is complementary, or conforms, to the geometry of the outer surface 128 of the back-up member 116 at a first end of the seal ring stack 100. At the other end of the sealing ring stack, the back-up member 118 may be received in an abutment face 130 wherein again, the shoulder 134 may conform to the outer surface 132 of the opposing back-up member 118. As illustrated, the abutment face is "V" shaped; however, other geometries may be utilized. For example, FIG. 1*b* illustrates an abutment face 130 having a flat or rectangular geometry. The outer surface 128 of the back-up member has a similar geometry. The outer cylinder 122 retains the other side of the sealing ring stack 100. In further arrangements, the outer cylinder 122 may include a shoulder for retaining the sealing ring stack 100.

FIGS. 2*a* through 2*d* illustrate a top or (bottom) view (FIG. 2*a*), a cross-section view (FIG. 2*b*), and close-up views (FIGS. 2*c* and 2*d*) of the seal elements 200. As illustrated, the seal elements 200 each include a seal ring 202 and a swellable energizer 204, such as a swellable ring or strip, which is expandable when exposed to a solvent. The seal ring defines a central axis A1-A1, which is perpendicular to the diameter D of the seal ring 202. The seal ring 202 includes a groove 205, which is concave or extending into the seal body 210. As illustrated, the seal ring is generally "V" shaped. Alternatively, the sealing ring may include other symmetric profiles such as those seen in "U" seals, crown seals, etc. or asymmetric profiles such as "K" profiles, etc.

Figure 2A:
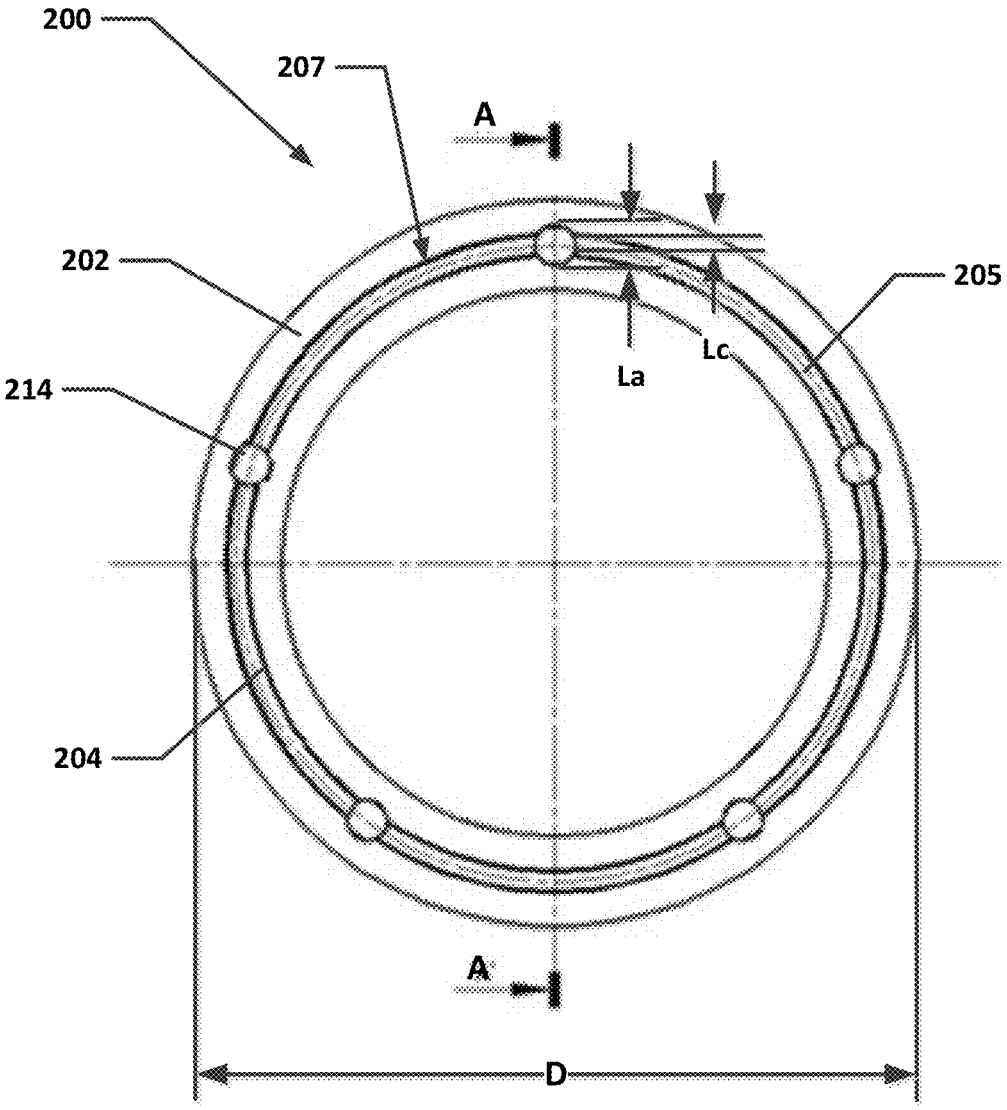
FIG. 2*a* illustrates a top view (or bottom view) of an embodiment of a sealing element.
Figure 2B:
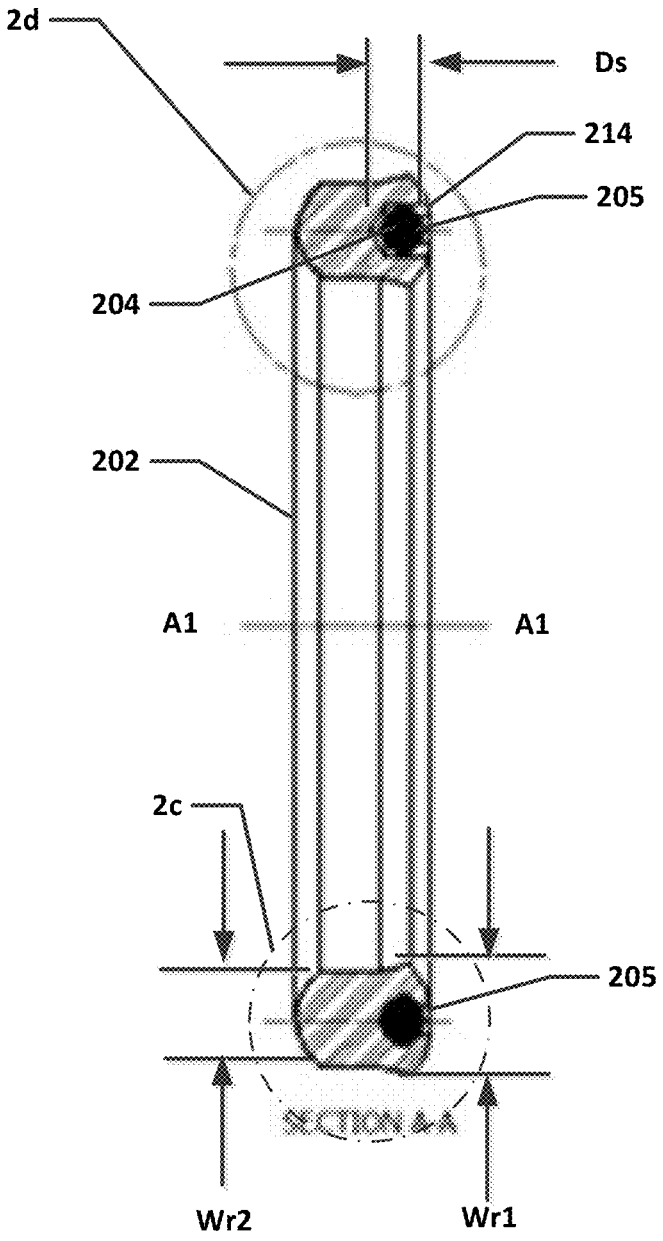
FIG. 2*b* illustrates a cross-sectional view of the sealing element of FIG. 2*a* taken at cross-section 'A'-'A'.
Figure 2C:
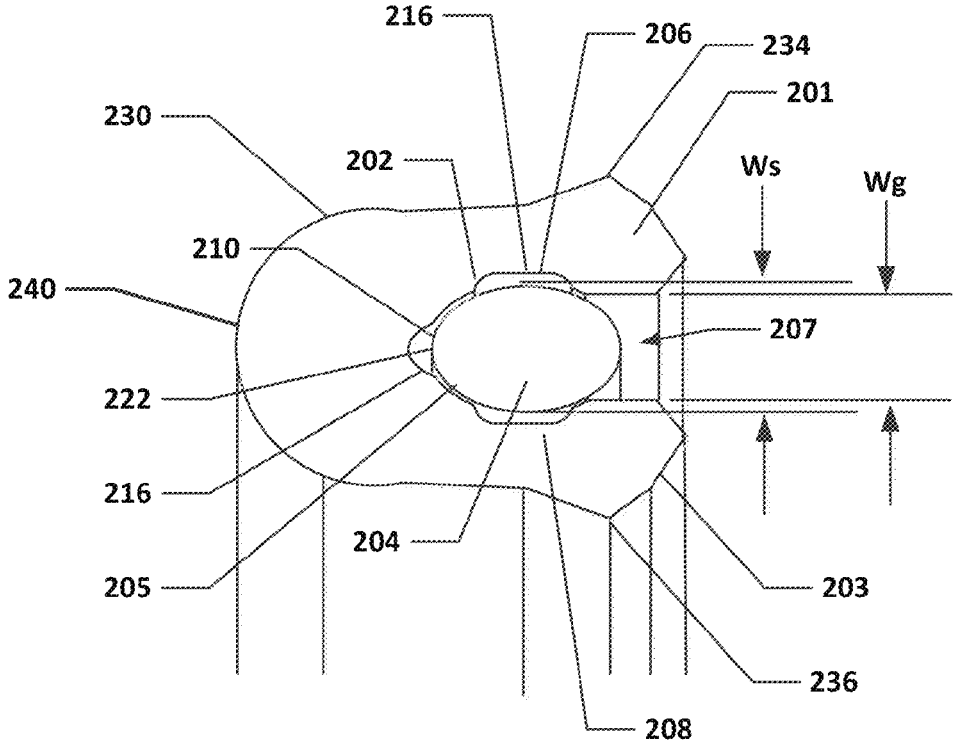
FIG. 2*c* illustrates a close-up view of the cross-sectional view 2*c* of FIG. 2*b;*

The groove 205 creates a chamber in which the swellable energizer 204 is either partially or completely disposed in to retain the swellable energizer 204 as illustrated in FIG. 2*c*. The groove opening 207 is defined at one end of the seal ring. As illustrated, the groove opening 207 is perpendicular to axis A1-A1 defined by the annular seal. However, the opening 207 may be at an angle in the range of 60° to 120° from the central axis A1-A1.

Figure 2D:
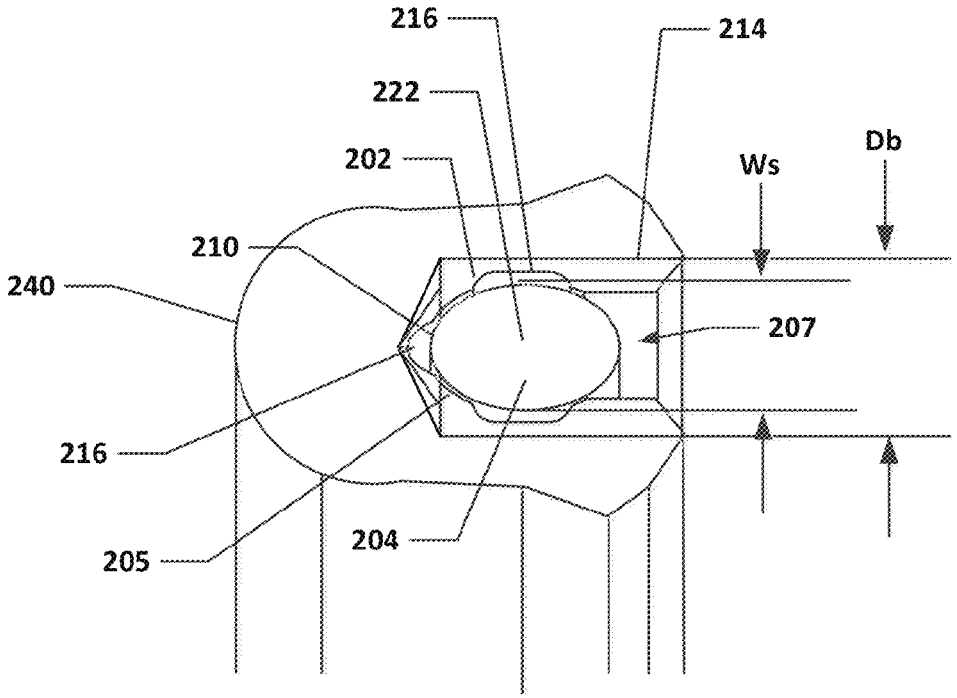
FIG. 2*d* illustrates a close-up view of the cross-section view 2*d* of FIG. 2*b;*

In embodiments, the profile of the groove may conform to the profile of the seal as illustrated in FIG. 2*c*. In addition, as illustrated in FIG. 2*c*, the width of the opening 207 of the groove 205, Wg, is less than the width of the swellable energizer 204, $W_S$, except where blind holes 214 are formed (described below) in the groove, wherein the longest length or diameter of the blind hole Db is greater than the width Ws of the swellable energizer as illustrated in FIG. 2*d*.

As alluded to above, the sealing rings 202 may also include both blind holes 214 and circumferential passages 216 in the rings to promote fluid ingress into the swellable ring chamber. As illustrated in FIG. 2*a*, five axial blind holes 214 are spaced circumferentially around the seal ring at even or uniform intervals and intersect the groove, i.e. they are cut through the groove, such that solvent may flow into the blind holes and into the groove. The blind holes 214 are illustrated as being circular in cross-section, however, other geometries may be assumed as well. In addition, the diameter blind hole Db may be larger than the width of the groove Wg.

The blind holes 214 extend into the ring up to the depth of the swellable energizer Ds, as illustrated in FIG. 2*b*, including all values and ranges from 10% to 100% of the swellable energizer depth, including all values and ranges therein, such as 75%, 80%, 85%, 90%, 95%, etc., wherein the swellable energizer depth Ds is reference to the farthest point from the surface the swellable energizer extends into the seal ring. As illustrated, the blind holes 214 extend parallel to the central axis A1-A1 of the sealing ring. However, in other embodiments, the blind holes 214 may extend into the seal ring at angles in the range of +/−45° from the central axis A1-A1.

Less than five or more than five blind holes may alternatively be present. Therefore, in the range of 1 to 20 blind holes may be present, including all values and ranges therein, such as 2 to 10, 4 to 8, etc. In addition, the blind holes 214 need not be spaced uniformly, circumferentially around the seal ring, but may also be spaced at uneven intervals around the circumference of the seal ring 202.

As illustrated in FIGS. 2*a* and 2*c*, the sealing rings 202 also include circumferential passages 216 extend radially around the circumference of the groove 205. As illustrated in FIG. 2*c*, passages 216 are provided on opposing internal surfaces 206, 208 of the groove as well as at the bottom 222 of the groove 205 opposing the groove opening 207. In embodiments, in the range of 1 to 5 circumference passages may be provided in the groove 205. As illustrated, the passages exhibit a semicircular geometric shape. However, the passages may assume other geometries as well. In embodiments, the passages connect to the blind holes allowing the ingress of solvent into the passages, such that the solvent may contact the swellable energizer around the entire swellable energizer surface.

As illustrated, the exterior surface 230 of the sealing ring 210 is symmetrically flared out near the opening 207 of the groove 205, forming a bell shape. That is, as seen in FIG. 2*b*, the overall width of the sealing ring Wr1 is greater near the opening than the width Wr2 at the opposing end. Furthermore, the exterior surface of the sealing ring may be convex, or curved outward near the opening 207 of the groove, wherein the curvature terminates at the flare 234, 236 of projections 201, 203. In addition, the thickness of the projections 201, 203 may vary along their length. For example, as illustrated, at the flares the projections may exhibit a greater thickness than near the location where the projections join the seal ring body 210. In embodiments, the flare may be asymmetric around the sealing ring, or the flare may not be present at all. Finally, the end of the sealing ring 240 opposing the opening 207 may also be convex or rounded outward.

Solvent, such as a hydrocarbons or process water may enter the seal ring through the opening 207 and the blind holes 214. The solvent then passes through the passages 216. Hydrocarbons may include oil or natural gas, or non-aqueous muds (oil drilling muds). Process water may include brine, salt water, water-based mud, or water containing minerals, or other water which is naturally located under the ground surface or fed into the well bore.

The sealing rings 202 may be formed of a fluoropolymer, such as PTFE, or an elastomer, which may include fluoroelastomers. Examples of elastomers for use herein include nitrile butadiene rubber (NBR), hydrogenated nitrile butadiene rubber (HNBR), fluoroelastomers (FKM as defined by ASTM D1418-10a, including vinylidene fluoride, hexafluoropropylene, tetrafluoroethylene, perfluoromethylvinylether, and combinations thereof as well as combinations including propylene or ethylene, such as TFE-P), perfluoro-elastomers (FFKM), tetrafluoro ethylene/propylene rubbers (FEPM), etc. Each of the sealing rings 202 may be formed from the same or different materials.

The swellable energizer 204 is illustrated as an annular ring or strip, having an oblong cross section positioned within the groove of the sealing ring. Other cross-sections may be assumed. The swellable energizer is also illustrated as being wholly embedded within the seal ring groove 205. However, in embodiments, the swellable energizer may protrude or extend from the groove. The swellable energizer 204 is formed from an elastomer that exhibits a greater expansion upon exposure to a given solvent than the seal ring 202 material. Examples of such materials include nitrile-butadiene rubber (NBR), hydrogenated NBR (HNBR), chemically functionalized NBR (XNBR), ethylene-propylene-diene-copolymer (EPDM), ethylene-propylene rubber (EPR), fluorinated elastomers (FKM, FFKM. FEPM), styrene-isoprene rubber (SBR), hydrogenated styrene-isoprene rubber (HSBR), isoprene-butadiene rubber (IBR), hydrogenated isoprene-butadiene rubber (HIBR), styrene-isoprene rubber (SIR), hydrogenated styrene-isoprene rubber (HSIR), styrene-butadiene-isoprene rubber (SIBR), hydrogenated styrene-butadiene-isoprene rubber (HSIBR), block, triblock and multi-block polymers of styrene-isoprene, styrene-butadiene, styrene-butadiene-isoprene thermoplastic elastomers, hydrogenated block, triblock and multi-block polymers of styrene-isoprene, styrene-butadiene, styrene-butadiene-isoprene thermoplastic elastomers, silicone rubbers, chlorosulfonated polyethylene (CSM), or mixtures and combinations thereof. Additives may be used to enhance the swelling of the elastomers.

The swellable energizer may expand up to 300% of the initial volume, including all values and ranges therein, such as 1% to 300%, 10% to 50%, 50% to 250%, 75% to 125%, etc. Swelling may occur at temperatures in the range of 20° C. to 200° C., including all values and ranges therein, such as 80° C. to 150° C. and upon exposure to solvents for a time period in the range of 1 hour to 30 days, such as in the range of 1 day to 15 days. In preferred embodiments, the material swells up to 300%, including between 1% of the initial volume to 300% of the initial volume, of the initial volume at temperature in the range of 80° C. to 150° C., upon exposure to solvents for a time period in the range of 1 day to 15 days.

Due to the swelling of the swellable energizer, the outer diameter of the sealing ring may expand up to 50% of the initial outer diameter, including all values and ranges therein, such as 1% to 10%, 25% to 50%, 15% to 25%, etc., or the inner diameter of the sealing ring may contract down as much as 50% of the initial inner diameter including all values and range therein, such as 50% to 99%, 75% to 95%, 85% to 90%, etc., depending if is a piston or a rod seal respectively when exposed to the same given solvent. The seal ring does not swell due to the presence of the solvent or, if it swells at all, it may swell less than the swellable energizer and, in embodiments expand up to 20% of its initial volume, including all values and ranges from 0% to 20%, 1% to 20%, 5% to 10%, etc. Upon exposure of the swellable energizer 204 to the solvent, the swellable energizer 204 may swell and expand the seal ring 202, mechanically, in which the swellable energizer is confined or enclosed.

Referring again to FIG. 1*a*, the sealing elements are stacked such that the openings 150 of the sealing element sealing rings face the central spacer 112. By expanding the seal ring outwardly, the seal ring may contact damaged surfaces 140 of the casing bore as illustrated, or damaged surfaces of the interior casing, or any other damaged equipment typically present in oil or gas well completions (i.e. safety valves, packers, sliding sleeves, polished bore receptacle, liner hangers, etc). As may be appreciated, damaged surfaces, which are damaged by corrosion, wear or both exhibit irregular geometries or larger linear cross-sections than undamaged surfaces. In embodiments, the flared portions of the seal ring to contact these surfaces forming a seal upon expansion of the swellable energizers.

Attention is again drawn to FIG. 1*a* which also illustrates the use of a center spacer 112. The center spacer 112 is positioned between two or more seal rings, such as 104 and 106 as illustrated. Again, the openings 150, (see 207 of FIG. 2*c*), of the seal rings point towards the central spacer 112 when the seal ring stack is assembled. The center spacer 112 may be formed from a thermoplastic polymer, such as polyether ether ketone (PEEK), polytetrafluorothylene (PTFE), polyetherimide (PEI), nylon, polyoxymethylene (POM) or other thermoplastic polymers that exhibit a relatively high melting point of greater than 300° F. and exhibit relatively limited solubility or expansion upon exposure to hydrocarbon or aqueous solvents, including those mentioned above. As illustrated, the center spacer is annular in shape and exhibits a square or rectangular cross-section. However, other cross-sections may be assumed, such as circular or oval. Additional spacers 152 may be provided between the sealing elements as illustrated, or the sealing elements may abut one another directly on either side of the center spacer 112.

Back-ups 116 and 118 are provided at opposing ends of the seal stack 100. The back-ups may be understood as elements used to hold the sealing elements within the seal gland and may act as anti-extrusion elements preventing the seal elements from being deformed and pushed into the annulus between the inner and outer cylinders outside of the seal gland 120. Like the center spacer, the back-ups may be formed from a thermoplastic polymer, such as polyether ether ketone (PEEK), polytetrafluorothylene (PTFE), polyetherimide (PEI), nylon, polyoxymethylene (POM) or other thermoplastic polymers that exhibit a relatively high melting point of greater than 300° F. and exhibit relatively limited solubility or expansion upon exposure to hydrocarbon or aqueous solvents, including those mentioned above.

Figure 3:
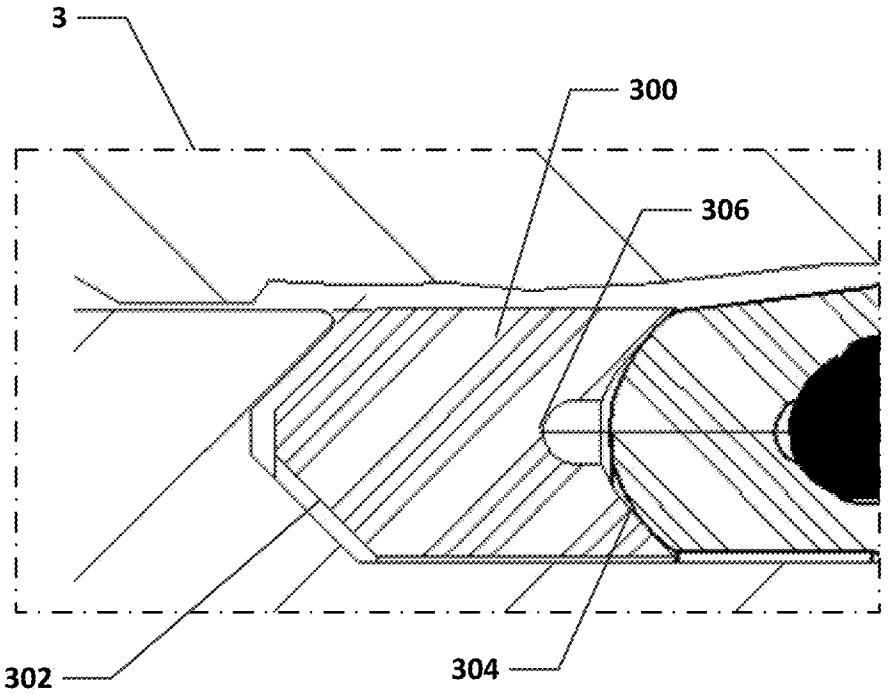
FIG. 3 illustrates a close-up view of the cross-section of FIG. 1 at section 3 illustrating a back-up.

As illustrated in FIG. 3, which is a close up of FIG. 1 at section 3, the back-ups 300 are also annular and exhibit a V-shaped or chevron shaped cross-section. As noted above, the back-ups may exhibit a rectangular cross-section as well as other cross-sections. The exterior surface 302, i.e., the surface of the back-ups at the exterior of the stacked rings, exhibits a "V" or "U" shape. However, other shapes may also be exhibited, such as circular or oval. The interior surface 304, which opposes the exterior surface 302, exhibits a concave profile or depressed radius. At the bottom of the depressed radius, a passageway 306 may be defined creating a recess and allowing for flexing of the back-up.

Figure 4A:
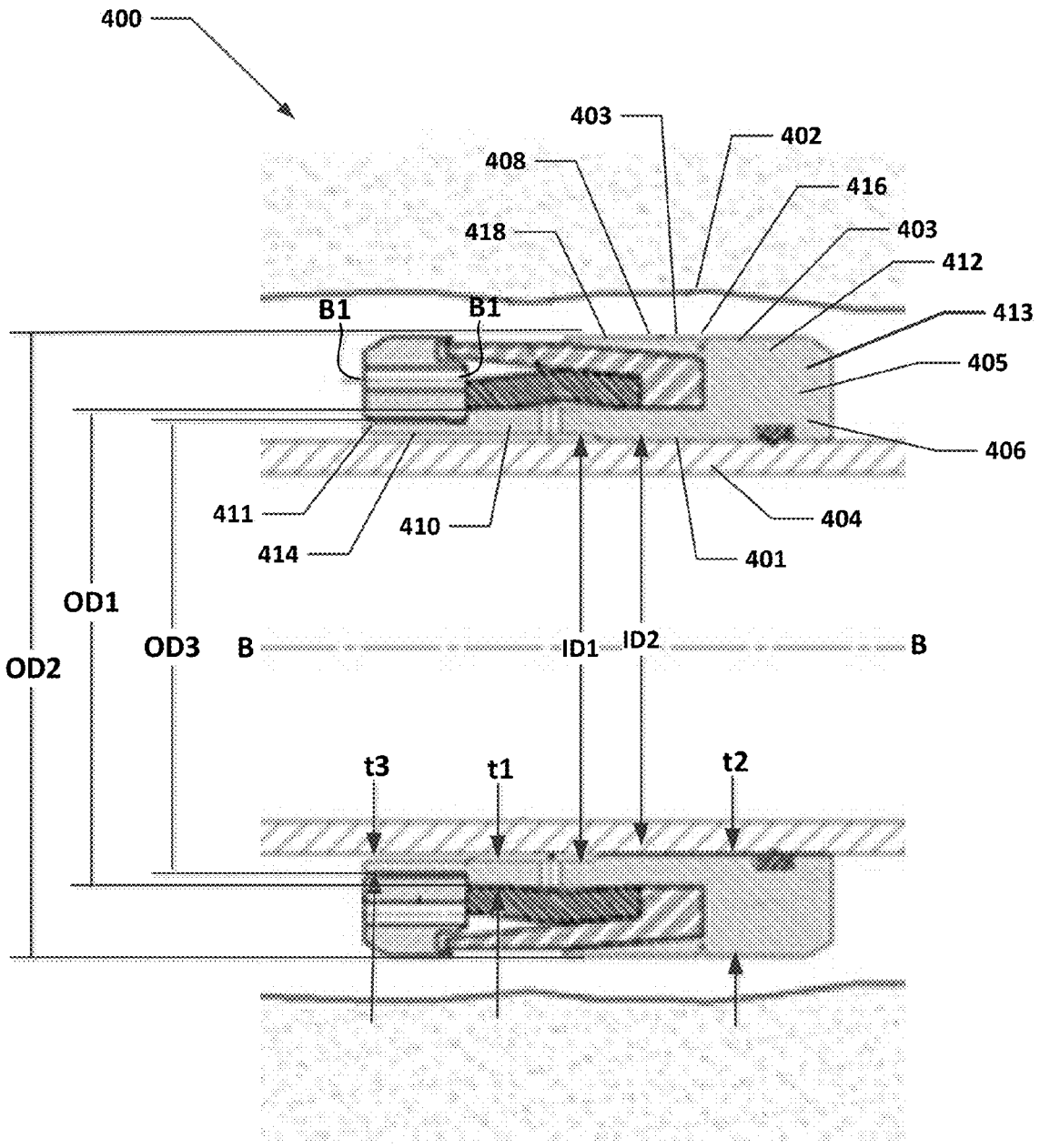
FIG. 4*a* illustrates a cross-section of an embodiment of a cup seal sub-assembly including a swellable energizer, a cup seal and a carriage as configured during placement of the sub-assembly down the well bore.
Figure 4B:
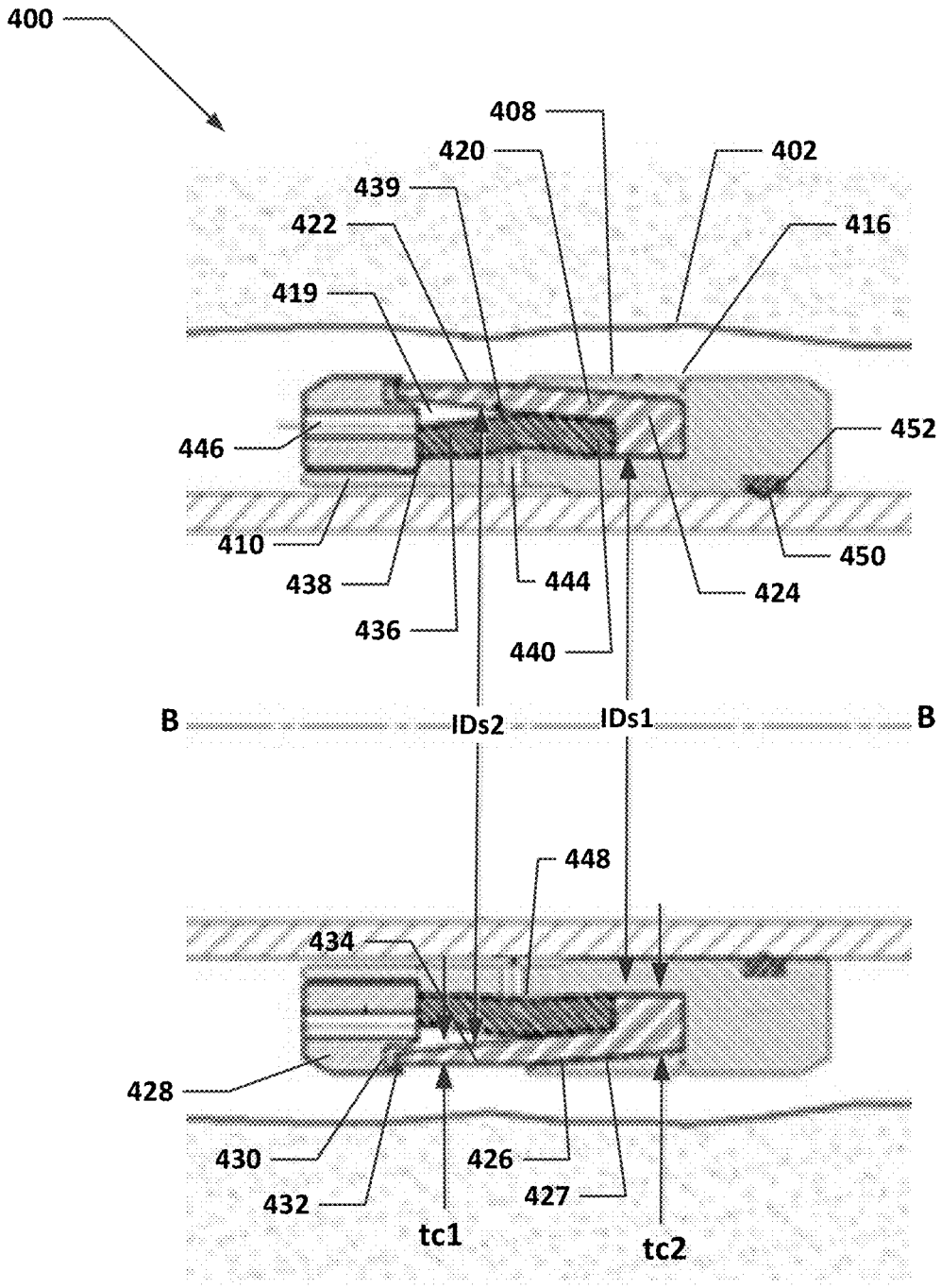
FIG. 4*b* illustrates the cup seal of FIG. 4*a*.
Figure 4C:
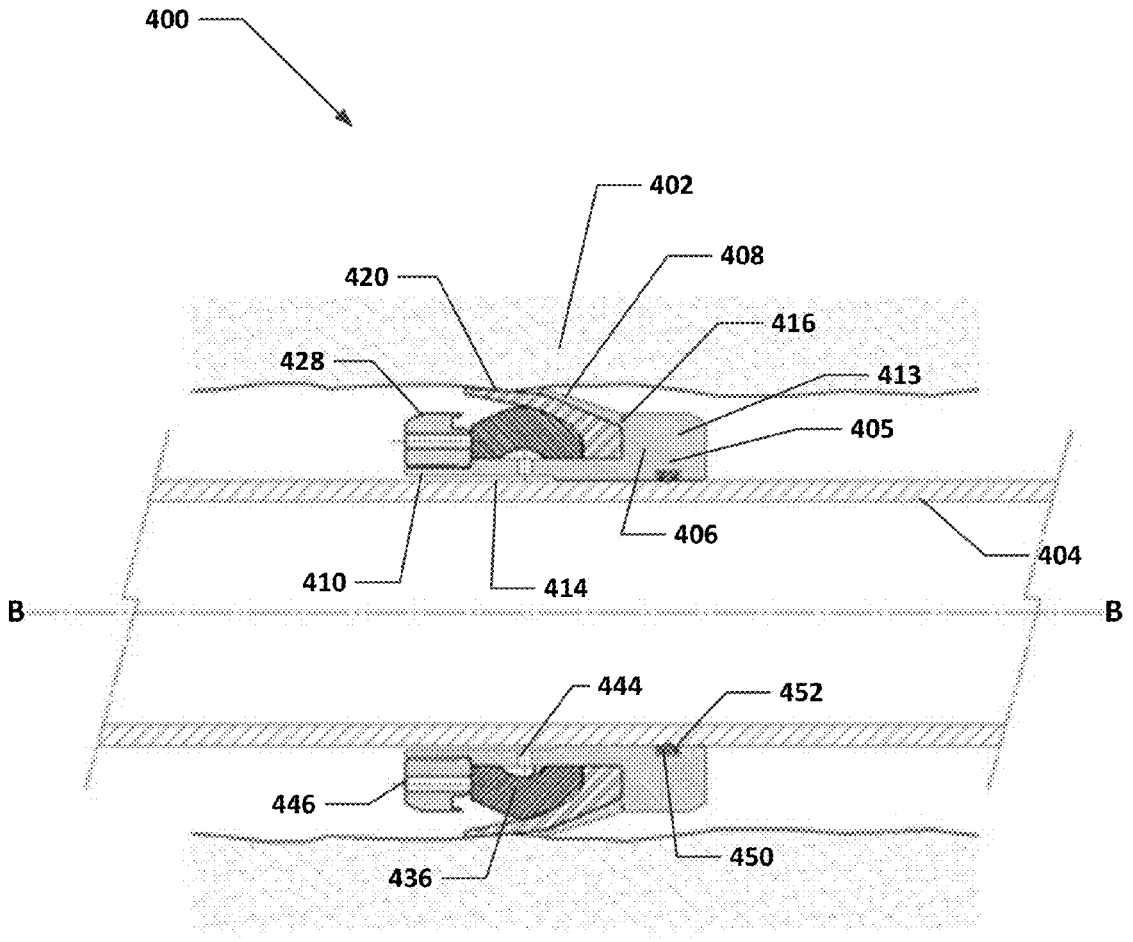
FIG. 4*c* illustrates the cup seal of FIGS. 4*a* and 4*b* in the set or expanded position.

In another embodiment, illustrated in FIGS. 4*a* through 4*c*, a swellable energizer is utilized in a cup seal sub-assembly 400. FIG. 4*a* illustrates the configuration of the seal 400 when "run in" the annulus between the well bore 402 and the production pipe or a packer mandrel 404. FIG. 4*b* further illustrates the configuration of the seal 400. FIG. 4*c* illustrates the configuration of the seal 400 when set within the well bore 402.

Referring to FIG. 4*a* the seal 400 is annular in shape around central axis B-B. The seal includes a back-up 405 formed from a carriage 406 and one or more fingers 408 extending from the carriage. The carriage may be made of low alloy steel, such as AISI 4140. In addition, other materials may be used as well such as S13Cr stainless steel, L80 steel, 13% Cr steel, INCONEL 718, etc. The carriage defines an interior surface 401 and an exterior surface 403. The carriage includes a leg portion 410 at a first end 411 and a body portion 412 at a second end 413. As illustrated the leg portion 410 of the carriage 406 extends from the body portion 412 of the carriage radially proximal to the production pipe or packer mandrel 104. The leg portion 410 of the carriage exhibits a smaller outer diameter OD1 than the outer diameter OD2 of the body portion 412. Accordingly, the cross-section of the carriage may generally be described to exhibit an "L" or "J" shape, which is mirrored about central axis B-B. In such a manner the leg portion 410 exhibits a first thickness t1 that is less than the thickness i.e., a second thickness t2, of the body portion 412 of the carriage.

In embodiments, the leg portion 410 may also exhibit one or more transitions in thickness, from the first thickness t1 proximal to the body portion 412 to a smaller thickness, i.e., a third thickness t3, distal from the body portion 412. For example, the leg portion 410 may exhibit a first inner diameter ID1 that is greater than a second inner diameter ID2. This forms an annulus 414 between the carriage and the production pipe or packer carriage. In addition, the first outer diameter OD1 near the body portion 412 is larger than a third outer diameter OD3 distal from the body portion 412.

One or more fingers extend from the body portion 412 of the carriage at the outer diameter and overlie a portion of the leg portion 410. The fingers 408 are hingedly connected to the carriage and are capable of hinging away or outwardly from the carriage and the first end. Alternatively, a spring may be molded into the cup as an anti-extrusion body. For example, the hinge 416 may be formed by milling a "v"-shaped section out of the carriage. Or, another mechanical hinge may be provided to rotate the fingers outward and away from the exterior surface 418 of the seal. The carriage and fingers may be formed of low alloy steel, such as AISI 4140. In addition, other materials may be used as well such as S13Cr stainless steel, L80 steel, 13% Cr steel, INCONEL 718, etc.

Referring now to FIG. 4*b*, within the space or cavity 419 provided between the fingers 408 and the leg portion 410 of the carriage 406 is positioned a cup seal 420. As illustrated, the cup seal is also "L" or "J" shaped wherein one end 422 of the cup seal, i.e., the sealing projection, has a first thickness tc1 that is smaller than the other end of the cup seal 424, i.e. the cup body, having a second thickness tc2. The thinner end of the cup seal 422 is distal from the body portion 412 of the carriage 406 and the cup body 424 of the cup seal is positioned proximal to the body portion 412 of the carriage 406. The cup seal body 424 radially spaces the sealing projection 422 from the leg portion 410 of the carriage 406. The cup seal 420 exhibits a first inner diameter IDs1 at the body portion 424, which is smaller than the second inner diameter of the cup seal IDs2 at the sealing projection 422, regardless of whether the cup seal is set. In embodiments, the sealing projection 422 of the cup seal radially tapers from the body end 424. In addition, the external surface 426 of the cup seal contacts the internal surface 427 of the fingers 408.

In embodiments, the cup seal 420 is formed of an elastomer. The elastomer may exhibit a Shore A durometer in the range of 60 to 100, including all values and ranges therein such as 70 to 80, 70, etc. Elastomers may be selected from one or more of the following, for example, polyurethane, silicone, polyvinyl chloride, butyl rubber, polybutadiene, nitrile butadiene rubber, hydrogenated nitrile butadiene rubber, ethylene-propylene rubber, etc.

A retainer ring 428 is positioned around the carriage 406 at the thinner, leg end 410 of the carriage distally away from the body portion 412 of the carriage. The retainer ring 428 includes a recess 430 on the surface 434 of the retainer ring facing the cup seal with a lip 432 overhanging the recess 430. The lip holds the cup seal down and substantially parallel to the carriage during run in, wherein substantially parallel may be understood to exhibit an angle of 30° or less, including all values and ranges from 0° to 30° relative to central axis B-B. The retainer ring 428 may be formed of low alloy steel, such as AISI 4140. In addition, other materials may be used as well such as S13Cr stainless steel, L80 steel, 13% Cr steel, INCONEL 718, etc. As illustrated, the retainer ring 428 is annular.

Positioned or retained between the cup seal 420 and the leg portion 410 of the carriage 406 is the swellable energizer 436. The swellable energizer 436 may be affixed at either end 438, 440 to the carriage 406, retainer ring 428, cup seal 420, or combinations thereof. In embodiments, the swellable energizer 436 is annular and exhibits an elongate cross-section with an arced profile, wherein the central portion 439 of the swellable energizer extends radially away from the leg portion of the carriage and form a cavity 448 between the actuator 436 and the carriage 406. The swellable energizer 436 may be formed of a nitrile-butadiene rubber (NBR), hydrogenated NBR (HNBR), chemically functionalized NBR (XNBR), ethylene-propylene-diene-copolymer (EPDM), ethylene-propylene rubber (EPR), fluorinated elastomers (FKM, FFKM. FEPM), styrene-isoprene rubber (SBR), hydrogenated styrene-isoprene rubber (HSBR), isoprene-butadiene rubber (IBR), hydrogenated isoprene-butadiene rubber (HIBR), styrene-isoprene rubber (SIR), hydrogenated styrene-isoprene rubber (HSIR), styrene-butadiene-isoprene rubber (SIBR), hydrogenated styrene-butadiene-isoprene rubber (HSIBR), block, triblock and multi-block polymers of styrene-isoprene, styrene-butadiene, styrene-butadiene-isoprene thermoplastic elastomers, hydrogenated block, triblock and multi-block polymers of styrene-isoprene, styrene-butadiene, styrene-butadiene-isoprene thermoplastic elastomers, silicone rubbers, chlorosulfonated polyethylene (CSM), or mixtures and combinations thereof. Upon exposure to a solvent, such as hydrocarbons or process water, the swellable energizer 436 may expand to force the cup seal out 420 of the retainer ring lip 432 and extend the cup seal 420 outwardly from the carriage 406 and towards the well bore wall 402. The finger 408 bends with the cup seal 420 and support the cup seal 420, preventing the cup seal 420 from folding backwards towards the thicker portion of the carriage 406. The swellable energizer 436 may expand up to 300% of its original volume, including all values and ranges therein, such as 25%, 50%, 100%, 75% to 125%, etc.

The solvent may be provided to the swellable energizer 436 through an inlet 444 provided in the carriage 406. The inlet 444 may be a through-hole or bore that extends through the thickness of the thinner, leg end 410 of carriage 406 and opens into the annulus 414 that is formed between the carriage 406 and the production pipe or packer mandrel 404. Solvent may pass through the annulus 414, between the leg end 410 of the carriage 406 and the production pipe or packer mandrel 404, through the inlet 444 and into a cavity 448 defined between the leg portion 410 of the carriage 406 and the swellable energizer 436. As noted above, the leg end 410 of the carriage 406 may exhibit a first inner diameter ID1 that is greater than a second inner diameter ID2 of the body end 412 of the carriage. The transition between the first inner diameter ID1 and the second inner diameter ID2 may occur anywhere along the length of the carriage, provided that the inlet 444 can open into the annulus and fluid communication can be established. Stated another way, the transition between the first inner diameter ID1 and the second inner diameter ID2 occurs between the inlet 444 and the body portion of the carriage.

Additionally, or alternatively one or more inlets 446 may be provided in the retainer ring 428. As illustrated in FIG. 4*b*, at least two inlets 446 are provided in the retainer ring. The inlets 446 are through-holes or bores that are generally parallel to the central axis B-B of the production pipe or packer mandrel 404. That is, the inlet bores 446 define an axis B1-B1 that is at an angle of 30° or less, such as in the range of 0° to 30°, 1° to 30° relative to the central axis B-B. The through-holes of either the carriage inlet 444 or the retainer ring inlet 428 may exhibit a circular cross-section or oblong cross-sections, such as arced ellipses or arced ovals.

An internal seal 450 may also be provided between the carriage 406 and the production pipe or packer mandrel 404. The annular internal seal 450 is disposed or positioned in a channel 452 radially defined in the internal surface 454 of the back-up carriage 406. As illustrated only one seal 450 is present, however more than one seal may be utilized such as in the range of 2 to 20 seals, including all values and increments therein, such as 4, 5, 10, 15, etc. Furthermore, as illustrated the seal is positioned in a location that opposes the annulus 414, so as not to block passage of solvent into the inlet 444. The seal may be formed from a non-swellable elastomers such as, nitrile butadiene rubber (NBR), hydrogenated nitrile butadiene rubber (HNBR), fluoroelastomers (FKM as defined by ASTM D1418-10a, including vinylidine fluoride, hexafluoroproprylene, tetrafluoroethylene, perfluoromethylvinylether, and combinations thereof as well as combinations including propylene or ethylene, such as TFE-P), perfluoro-elastomers (FFKM), tetrafluoro ethylene/propylene rubbers (FEPM), etc.

As alluded to above, the seal stack and cup seal sub-assembly illustrated in FIGS. 1 through 4*c* may be utilized in oil and gas wells, particularly in areas where damage 140 has occurred at the outer walls of the annulus in which the seal is presented. By extension of the seal rings in the seal stack illustrated in FIGS. 1 through 3 or the extension of the fingers and cup seal, outward from the carriage, in FIGS. 4*a* and 4*c*, the seals may press against portions of an outer wall that have a greater diameter than that of the remainder of the outer wall due to damage or wear. Open holes or damaged holes may be sealed with relatively increased seal performance as the swellable material is used for energizing the seal but not for sealing itself.

Methods are also provided herein of seals including swellable energizers. The methods may include exposing the swellable energizer to a solvent swelling the swellable energizer and expanding a seal in which the swellable energizer is positioned. As alluded to above, the solvent may include hydrocarbons, process water, or both. The swellable energizer may expand up to 300% of the initial volume as discussed above, including all values and ranges therein, such as 1% to 300%, 1% to 25%, 1% to 50%, 1% to 75%, 1% to 100%, etc. The swellable energizer may be exposed to the solvent intermittently or continuously over a period of time, such as in the range of 1 hour to 15 days, including all values and ranges therein, such as 1 day to 15 days, 2 days to 4 days, etc., at temperatures in the range of 20° C. to 200° C., 80° C. to 150° C., etc. Upon removing the solvent from the environment around the swellable energizer, the swellable energizer may decrease in size.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A seal stack, comprising:

a sealing element including an annular seal ring having a diameter and an axis defined therethrough perpendicular to said diameter, a groove defined in said seal ring, wherein said groove has an opening at a first end of said seal ring; and a swellable energizer disposed in said groove, wherein said swellable energizer swells upon exposure to a solvent causing said seal ring to expand; and a first annular back-up and a second annular back-up provided at opposing ends of said sealing element, wherein said first back-up includes an interior surface that receives a second end of said sealing element;

wherein:

said opening is at least partially defined by projections extending past said swellable energizer; and at least one of said projections comprises an internal surface proximate an outer surface of said swellable energizer, said internal surface comprising a circumferential passage extending radially around said groove, the circumferential passage defining a space between said swellable energizer and said at least one internal surface.

2. The seal stack of claim 1, wherein said groove retains said swellable energizer.

3. The seal stack of claim 1, further comprising:

a center spacer; and a first plurality of said sealing elements positioned at one end of said center spacer and a second plurality of sealing elements positioned at the opposite side of said center spacer, wherein said grooves of said sealing elements face said center spacer and said first and second plurality of sealing elements are positioned between said first annular back-up and said second annular back-up.

4. The seal stack of claim 1, wherein said groove opening exhibits a length that is smaller than a largest linear cross-section of said swellable energizer.

5. The seal stack of claim 1, wherein said sealing ring further includes an blind hole intersecting said groove, said blind hole exhibits a diameter that is larger than a cross-section of said swellable energizer, and said blind hole has an opening length that is larger than the length of said groove opening.

6. The seal stack of claim 5, wherein said swellable energizer is positioned within said seal ring to a depth and said blind hole extends into said seal ring in the range of 10% to 100% of said swellable energizer depth.

7. The seal stack of claim 1, wherein:

projections comprise a first projection comprising a first internal surface and a second projection comprising a second internal surface opposing said first internal surface; and each of said first and second internal surfaces comprises a circumferential passage extending radially around said groove, wherein each circumferential passage defines a space between a respective one of said first and second internal surfaces and said swellable energizer.

8. The seal stack of claim 1, wherein said swellable energizer is formed of ethylene-propylene-diene-copolymer (EPDM).

9. The seal stack of claim 1, wherein said swellable energizer exhibits an initial volume and expands up to 300% of said initial volume when exposed to hydrocarbon or brine solvents at a temperature in the range of 80 to 150° C. for a time period in the range of 1 to 15 days.

10. A cup seal sub-assembly, comprising:

a carriage including an interior surface and an exterior surface, a leg portion forming a portion of the inner diameter of said carriage, and a body portion;

a finger extending from said body portion of said carriage;

a cup seal positioned between said leg portion of said carriage and said finger, wherein said cup seal includes a sealing projection and at least a portion of an external surface of said sealing projection contacts an internal surface of said finger; and a swellable energizer positioned between said leg portion of said carriage and said cup seal, wherein upon swelling said swellable energizer extends said sealing projection and finger outward from said carriage.

11. The cup seal sub-assembly of claim 10, further comprising a hinge between said finger and said carriage body.

12. The cup seal sub-assembly of claim 10, further comprising:

a channel defined radially around the interior surface of said carriage and an internal seal disposed in said channel.

13. The cup seal sub-assembly of claim 10, further comprising an inlet provided in said leg portion of said carriage, wherein said swellable energizer forms a cavity between said swellable energizer and said leg portion and said inlet provides an opening between said interior surface of said carriage and said cavity.

14. The cup seal sub-assembly of claim 13, wherein said interior surface exhibits a first inner diameter and a second inner diameter, wherein said first inner diameter is greater than said second inner diameter and said interior surface transitions from said first inner diameter to said second inner diameter between said inlet and said body portion of said carriage.

15. The cup seal sub-assembly of claim 10, further comprising a retainer ring positioned around the leg portion of the carriage distal from said body portion of said carriage, wherein said retainer ring includes a lip for retaining said sealing projection.

16. The cup seal sub-assembly of claim 10, further comprising an inlet provided in said retainer ring, wherein said retainer ring exhibits a first central axis and said inlet defines a second central axis that is 30° or less relative to the first central axis.

17. The cup seal sub-assembly of claim 10, wherein said swellable energizer is formed of ethylene-propylene-diene-copolymer (EPDM).

18. The cup seal sub-assembly of claim 10, wherein said swellable actuator exhibit an expansion up to 300% from an original volume in the presence of hydrocarbon or brine solvents after an exposure time of 1 to 15 days at a temperature of 80 to 150° C.

19. The cup seal sub-assembly of claim 10, wherein said cup seal is formed from an elastomer exhibiting a Shore A Durometer in the range of 60 to 100.

20. The cup seal sub-assembly of claim 10, wherein said cup seal is formed from one or more elastomers selected from the group consisting of polyurethane, silicone, polyvinyl chloride, butyl rubber, polybutadiene, nitrile butadiene rubber, hydrogenated nitrile butadiene rubber and ethylene propylene rubber.

* * * * *